US009372435B2

(12) United States Patent
Abe et al.

(10) Patent No.: US 9,372,435 B2
(45) Date of Patent: Jun. 21, 2016

(54) TONER CARRIER

(71) Applicants: Hiroya Abe, Yokohama (JP); Masaki Watanabe, Kawasaki (JP); Yasutaka Shimizu, Tokyo (JP)

(72) Inventors: Hiroya Abe, Yokohama (JP); Masaki Watanabe, Kawasaki (JP); Yasutaka Shimizu, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/601,402

(22) Filed: Jan. 21, 2015

(65) Prior Publication Data

US 2015/0132033 A1 May 14, 2015

Related U.S. Application Data

(62) Division of application No. 14/151,038, filed on Jan. 9, 2014, now Pat. No. 8,971,754.

(30) Foreign Application Priority Data

Jan. 11, 2013 (JP) ..... 2013-003371

(51) Int. Cl.
*G03G 15/08* (2006.01)

(52) U.S. Cl.
CPC ..... *G03G 15/0808* (2013.01); *G03G 15/0817* (2013.01); *G03G 15/0818* (2013.01)

(58) Field of Classification Search
CPC ..... G03G 15/0817; G03G 15/0818; G03G 15/0898
See application file for complete search history.

(56) References Cited

U.S. PATENT DOCUMENTS

| | | | | |
|---|---|---|---|---|
| 5,378,525 | A * | 1/1995 | Yamamoto | G03G 15/0233 428/192 |
| 6,654,576 | B2 | 11/2003 | Dougherty | |
| 7,197,259 | B2 | 3/2007 | Ohshika | |
| 7,356,293 | B2 | 4/2008 | Mizumoto | |
| 2008/0310889 | A1 | 12/2008 | Nishikawa et al. | |
| 2009/0274482 | A1 * | 11/2009 | Xu | G03G 15/0817 399/105 |
| 2011/0142501 | A1 | 6/2011 | Kamiya et al. | |
| 2012/0294655 | A1 | 11/2012 | Terasaka et al. | |

FOREIGN PATENT DOCUMENTS

| | | |
|---|---|---|
| JP | 11-338243 | 12/1999 |
| JP | 2004-191430 | 7/2004 |
| JP | 2005-309191 | 11/2005 |
| JP | 2009-176156 | 7/2008 |
| JP | 2008-310252 | 12/2008 |
| JP | 2009-169210 | 7/2009 |
| JP | 4404108 | 1/2010 |
| JP | 2011-232527 | 11/2011 |

* cited by examiner

*Primary Examiner* — Gregory H Curran
(74) *Attorney, Agent, or Firm* — Cooper & Dunham LLP

(57) ABSTRACT

A toner carrier includes a metal core, a barrel formed on an outer circumference of the metal core and including at least an elastic layer, and a coating formed on outer circumferences of both ends of the barrel. The coating has a thickness and a width of an outer circumference of the coating is different from a width of an inner circumference of the coating. The width is from an end surface of the barrel along an axis of the barrel, and the width of the outer circumference is larger than the width of the inner circumference so that the end surface of the coating is reversely inclined.

9 Claims, 11 Drawing Sheets

TONER CARRIER

CROSS-REFERENCE TO RELATED APPLICATIONS

The present application is a divisional of U.S. application Ser. No. 14/151,038, filed on Jan. 9, 2014 which is based on and claims priority from Japanese Patent Application No. 2013-003371, filed with the Japanese Patent Office on Jan. 11, 2013, the disclosure of which is hereby incorporated by reference in its entirety.

BACKGROUND OF THE INVENTION

1. Field of the Invention

The present invention relates to a toner carrier used in an image forming device such as copier, facsimile machine, or printer, in particular, to a toner roller provided as a toner roller in a process cartridge or a develop unit of the image forming device.

2. Description of the Related Art

Heretofore, various types of develop unit have been used in an image forming device to develop an electrostatic latent image formed on an image carrier. Two kinds of develop unit, a two-component develop unit using a developer containing toner and carrier and a one-component develop unit using only toner as a developer are well known.

There are two types of one-component develop unit, that is, contact type and non-contact type. A contact-type develop unit develops an electrostatic latent image on the surface of an image carrier by allowing the toner on a toner carrier to contact the surface of the image carrier. Meanwhile, in a non-contact type develop unit the toner carrier is disposed to oppose the image carrier with a certain interval. It is configured to apply an alternating voltage to the toner carrier and generate an alternating electric field between the toner carrier and the image carrier to supply the toner from the toner carrier onto the image carrier and develop an electrostatic latent image thereon.

The toner carrier includes a metal core and a barrel on the outer circumference of the metal core. The barrel generally includes an elastic layer made from solid rubber or porous material as sponge.

Such a develop unit for use in the image forming device has a problem in leakage of toner from a gap between both ends of the barrel and a developer container. In particular a toner leakage is most likely to occur in the periphery of both ends of the barrel since it corresponds to an opening of the developer container.

Magnetic shielding effect does not apply to the one-component develop unit not containing carrier since toner is non-magnetic. To prevent the toner from leaking from the periphery of the barrel of the toner carrier, it is needed to occlude the space without a gap between both ends of the barrel and the opening of the developer container by pressing other elements onto a develop roller.

An end seal element can be provided to seal both ends of the barrel and block the toner from leaking outside. A restriction element such as a blade roller is used to properly limit the amount of toner and avoid an excessive toner from protruding. Japanese Patent Application Publication No. 2005-309191 (Reference 1), for example, discloses an auxiliary seal with which the gap between the restricting element and the end seal element is hermetically closed.

However, since the barrel of the toner carrier rotates with its both ends pressed onto the end sealer, a toner leakage may still occur over a long-term use due to wear-out of both ends by friction. Further, because of a friction heat occurring between both ends and the seal element, the temperature inside the developer container rises, deteriorating the toner. This results in toner's adhering on the restriction element, causing the generation of an image with white streaks and a toner dispersion which contaminates the inside of the image forming device.

In view of these problems, Japanese Patent No. 4561780 (Reference 2) discloses blasting the outer circumferences of both ends of the barrel and reducing a surface roughness of a blasted area.

Further, Japanese Patent No. 4404108 (Reference 3) discloses forming a spiral-form area on the outer circumferences of both ends of the barrel and setting the angle between the direction of the spiral and the rotational direction of the toner carrier to a sharp angle to prevent toner from leaking outside.

Moreover, Japanese Patent No. 3952428 (Reference 4) discloses providing a conductive layer on the outer circumference of a metal core and a coating containing polymethylsilsesquioxane on both ends of the outermost conducive layer, thereby to prevent a toner leakage due to a chipping or abrasion of barrel ends.

Meanwhile, along with high-speed operation of the image forming device, toner is more likely to enter between the barrel ends and end seal element, which may cause a toner dispersion or a frictional heat caused by the contingence between the toner and the barrel ends.

For example, References 2 and 3 use a hard roller having no elastic layer. Because of its hardness, the hard roller's adhesion with the end seal element is low, likely causing a toner leakage. To prevent the toner leakage, the pressing force of the barrel ends relative to the end seal element needs to be enlarged, leading to the generation of a frictional heat. Especially, the barrel is not made from a material with a low friction coefficient, therefore, it likely causes a frictional heat.

In Reference 4 there is no difference in the lengths of the outer circumference and inner circumference of the coating. Because of this, it cannot sufficiently seal toner over a long-time use or in high-speed operation of the image forming device, so that the toner may leak from both ends of the toner roller.

SUMMARY OF THE INVENTION

The object of the present invention is to provide a toner carrier which can prevent toner from leaking from both ends of a barrel of the toner carrier and reduce the occurrence of a friction heat at both ends of the barrel.

According to one embodiment, a toner carrier comprises a metal core, a barrel formed on an outer circumference of the metal core and including at least an elastic layer, and a coating formed on outer circumferences of both ends of the barrel, wherein the coating has a thickness, a width of an outer circumference of the coating is different from a width of an inner circumference of the coating, the width being from an end surface of the barrel along an axis of the barrel, and the width of the outer circumference is larger than the width of the inner circumference so that the end surface of the coating is reversely inclined.

BRIEF DESCRIPTION OF THE DRAWINGS

Features, embodiments, and advantages of the present invention will become apparent from the following detailed description with reference to the accompanying drawings:

FIG. 8A shows the overall exterior, FIG. 8B shows an enlarged G portion in FIG. 8A, and FIGS. 8C and 8D are other examples of the toner roller;

DETAILED DESCRIPTION OF THE PREFERRED EMBODIMENTS

Hereinafter, embodiments of the present invention will be described in detail with reference to the accompanying drawings. Wherever possible, the same reference numbers will be used throughout the drawings to refer to the same or like parts.

First Embodiment

Figure 1:
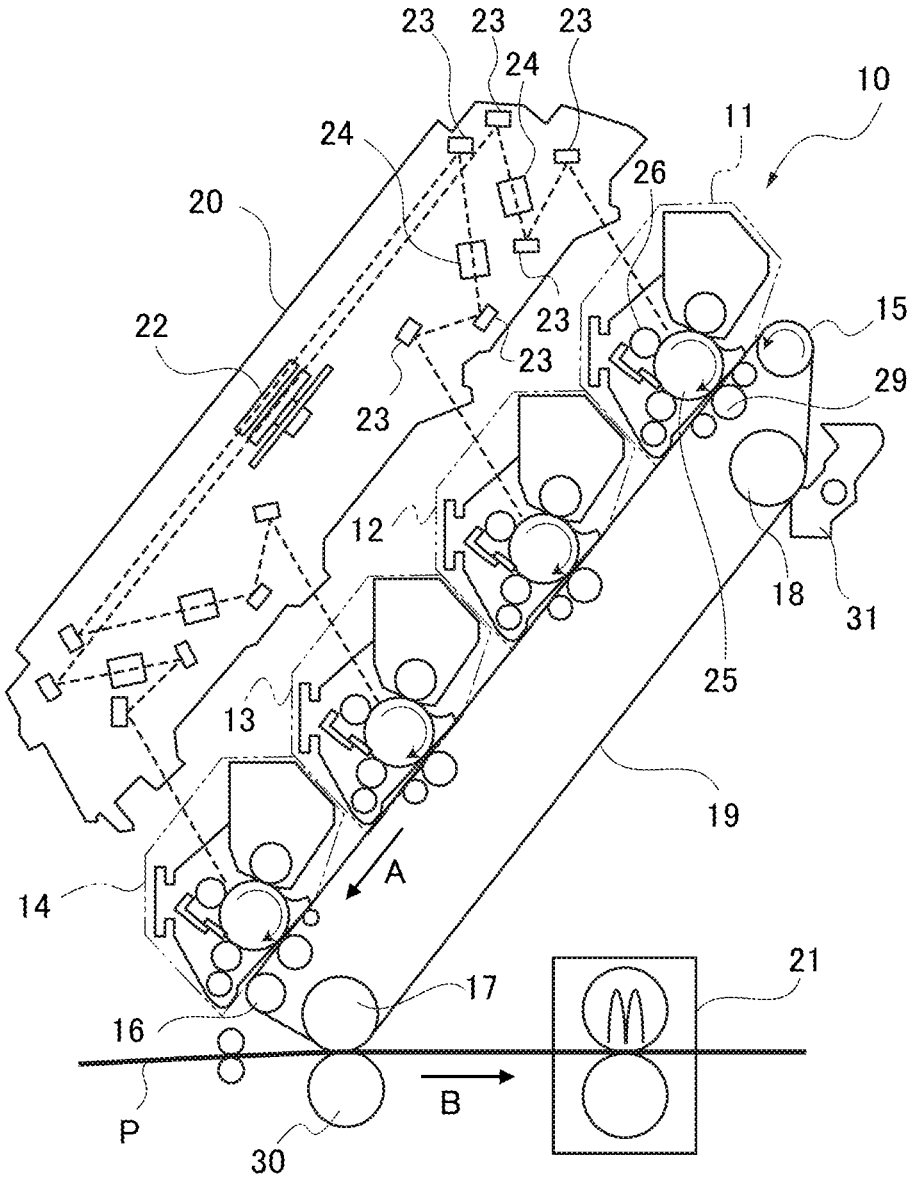
FIG. 1 schematically shows the inner structure of a printer as an electrophotographic image forming device.

FIG. 1 schematically shows the inner structure of a printer as an electrophotographic image forming device. A printer 10 in FIG. 1 comprises four process cartridges 11 to 14, an intermediate transfer belt 19 wound around belt rollers 15 to 18 and moving in a direction indicated by the arrow A, an exposure unit 20, and a fuser unit 21.

The exposure unit 20 includes an optical system having a polygon mirror 22, a reflective mirror 23, and a lens 24. A laser beam is projected from a not-shown laser diode and guided to the process cartridges 11 to 14 via the polygon mirror 22, reflective mirror 23, and lens 24. Although numeric codes are given only to the optical system which guides a laser beam to the process cartridges 11, 12 in FIG. 1, the optical system for the process cartridges 13, 14 are symmetrically placed relative to the optical system for the cartridges 11, 12 around the polygon mirror 22.

Figure 2:
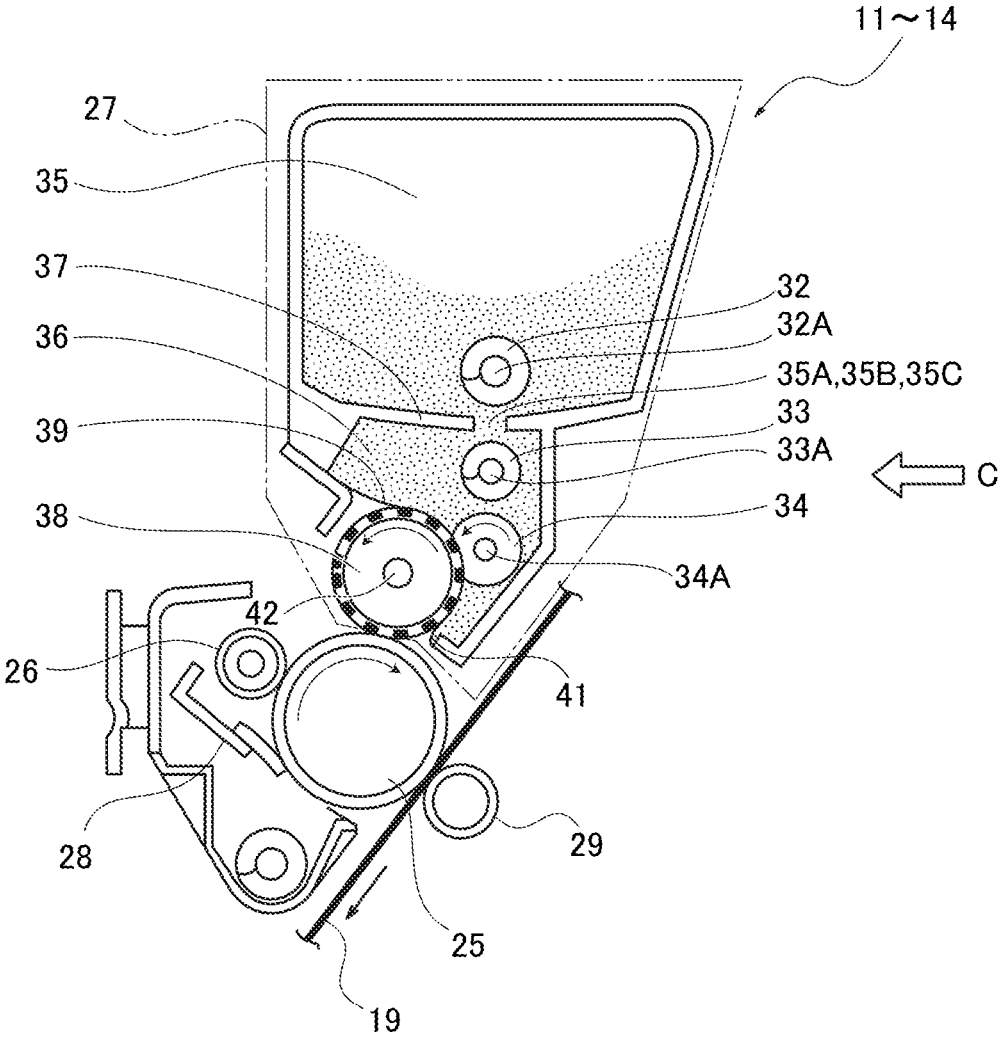
FIG. 2 is a cross sectional view of the inner structure of a process cartridge.

FIG. 2 shows an enlarged cross section of one of the four process cartridges 11 to 14. The process cartridges 11 to 14 each comprise a photoconductor drum 25 as an image carrier, a charge roller 26, a develop unit 27, and a cleaner 28, and these elements are unitized. The process cartridges 11 to 14 are detachable from the printer 10.

The photoconductor drums 25 rotate clockwise as indicated by the arrow in the drawing. The charge rollers 26 are pressed onto the photoconductor drums 25 and rotate along with the rotation of the photoconductor drums 25. While the printer 10 is in operation, the charge rollers 26 are applied with a certain bias from a not-shown high-voltage source to charge the surfaces of the photoconductor drums 25.

A non-contact type charge element such as corona charger can be used in replace of the above charge roller contacting the surface of the photoconductor drum 25.

The exposure unit 20 exposes the surfaces of the photoconductor drums 25 according to image information to form electrostatic latent images thereon. The exposure unit 20 is a laser beam scanner using a laser diode in the present embodiment, however, it can be other structures such as an LED array.

The cleaner 28 removes a remnant toner from the surfaces of the photoconductor drums 25 after the photoconductor drums contact the intermediate transfer belt 19, as shown in FIG. 1.

The process cartridges 11 to 14 are arranged in a moving direction of the intermediate transfer belt 19, to form yellow, cyan, magenta and black toner images on the photoconductor drums 25, respectively. They transfer the toner images from the photoconductor drums 25 along with the motion of the intermediate transfer belt 19 so that the images are superimposed in order onto the intermediate transfer belt 19, forming a visible image.

Primary transfer rollers 29 are placed near the photoconductor drums 25 on the opposite side of the intermediate transfer belt 19. They are applied with a primary transfer bias from a not-shown high voltage source to form a primary transfer electric field between the photoconductor drums 25 and primary transfer rollers 29. Thereby, the toner images are transferred onto the intermediate transfer belt 19 from the photoconductor drums 25. The four color toner images are transferred in order on the intermediate transfer belt 19 to form a full-color image while passing through the photoconductor drums 25 of the process cartridges 11 to 14.

A secondary transfer roller 17, one of the belt rollers 15 to 18, is provided at downstream of the process cartridges 11 to 14 (below the process cartridges 11 to 14 in FIG. 1) in the moving direction of the intermediate transfer belt 19. Another secondary transfer roller 30 is placed near the secondary transfer roller 17 on the opposite side of the intermediate transfer belt 19, to form a secondary transfer nip between the transfer roller 30 and the transfer belt 19. A certain voltage is applied between the secondary transfer rollers 17, 30 to form a secondary transfer electric field. Thereby, the full-color image is transferred from the intermediate transfer belt 19 onto a paper P when the paper passes through the secondary transfer nip. The paper P is carried along the arrow B in FIG. 1.

The fuser unit 21 is disposed at downstream of the paper carrying direction relative to the secondary transfer nip. Having passed the secondary transfer nip, the paper P reaches the fuser unit 21 and is applied with a heat and a pressure, so that the full-color image is fused on the paper P. Then, the paper P is discharged to the outside of the printer 10 while a remnant toner on the surface of the intermediate transfer belt 19 is recovered by a belt cleaner 31.

Next, the inner structure of the develop unit 27 is described in detail with reference to FIG. 2 to FIG. 5.

Figure 3:
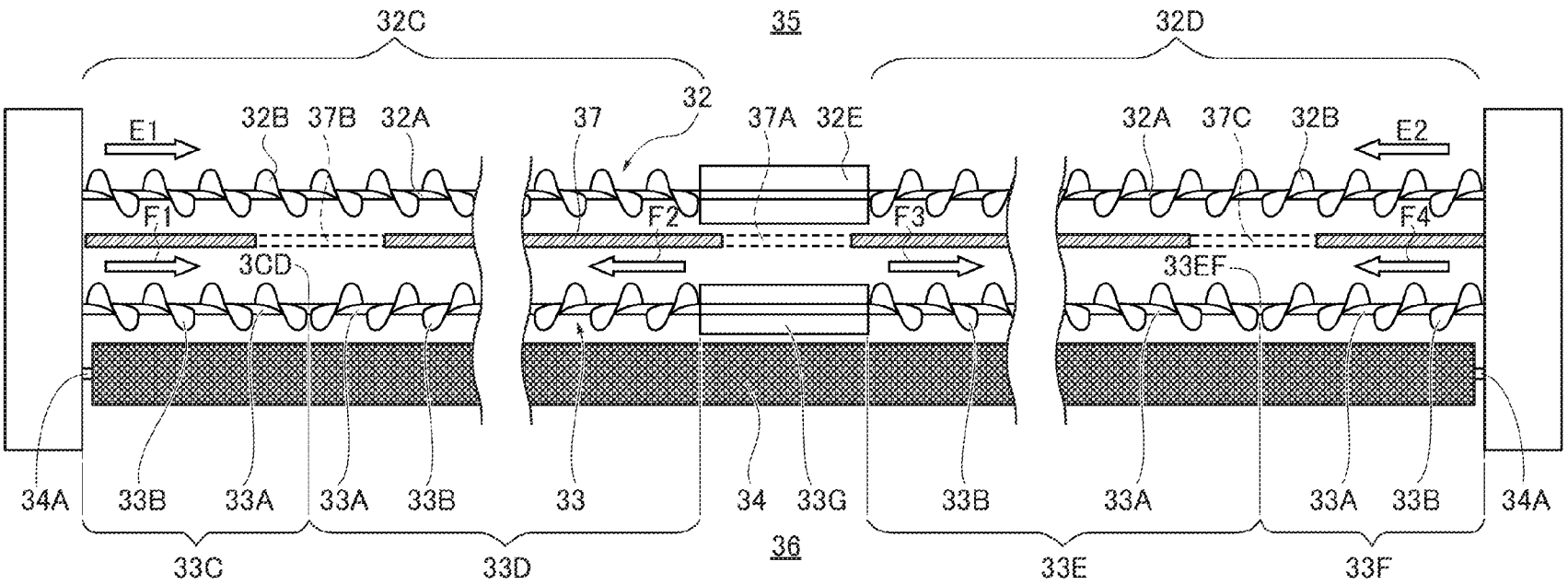
FIG. 3 is a schematic front view of a toner conveyer, a toner agitator, and a toner supply roller.

FIG. 3 is a front view of a toner conveyer 32, an agitator 33 and a toner supply roller 34 (as seen from the arrow C in FIG. 2). The toner conveyer 32, agitator 33, and toner supply roller 34 are arranged approximately in a line in vertical direction as shown in FIG. 2. They includes rotational shafts 32A, 33A, 34A horizontally (vertically in the drawing), respectively.

The develop units 27 in FIG. 2 each comprise a toner container 35 and a toner supply chamber 36 provided below the toner container 35 which are separated by a partition 37. The partition 37 is provided with an inlet 37A and outlets 37B, 37C. The inlet 37A is an opening to supply a toner from the toner container 35 to the toner supply chamber 36 while the outlets 37B, 37C are openings to return the toner from the chamber 36 to the toner container 35.

A toner roller 38 as a toner carrier is provided below the toner supply chamber 36, and a toner supply roller 34 and a toner layer restrictor 39 are placed in the toner supply chamber 36. The toner supply roller 34 contacts the toner roller 38 to supply the toner to the toner roller 38. The toner layer restrictor 39 contacts the toner roller 38 to restrict the thickness of a toner layer flowing to the opposite of the photoconductor drum 25 and the toner roller 38. The toner roller 38 is applied with a certain bias from a not-shown high voltage source.

Figure 4:
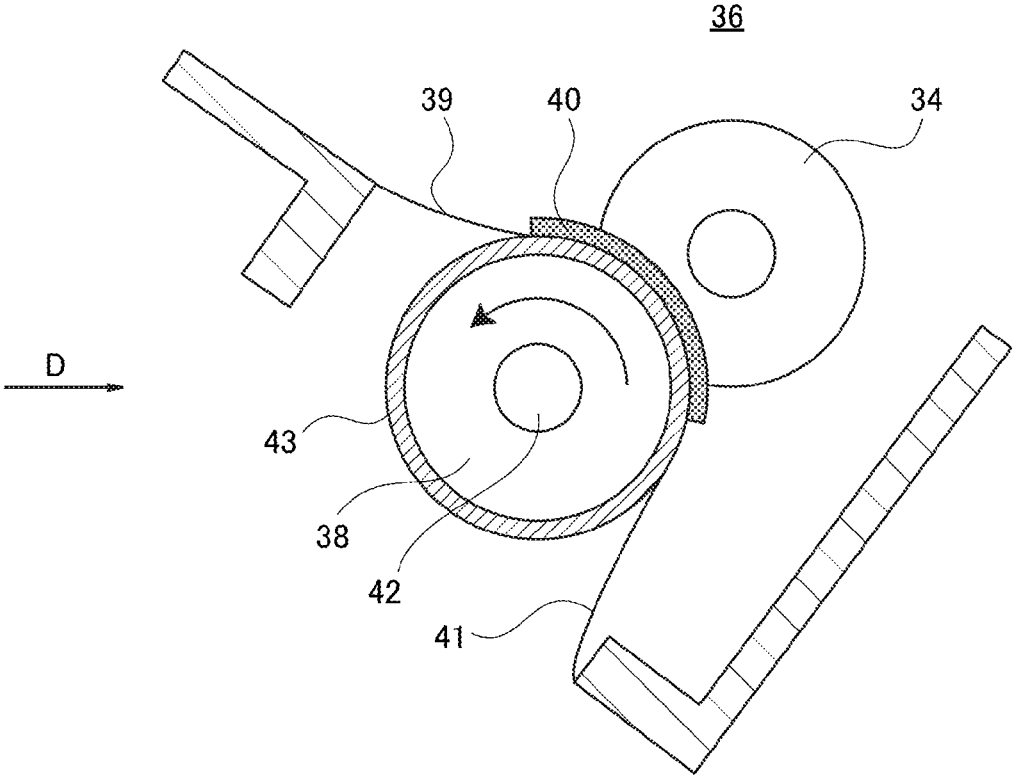
FIG. 4 is an enlarged cross sectional view of a toner roller.
Figure 5:
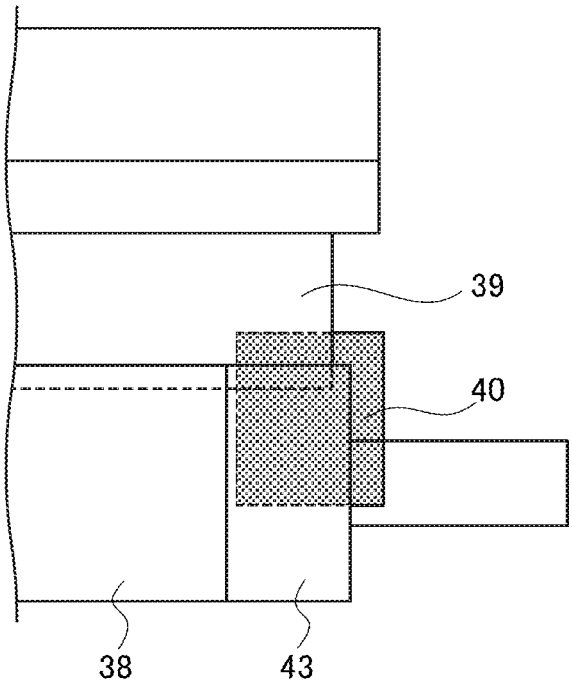
FIG. 5 shows the toner roller in FIG. 4 as seen from arrow D direction.

FIG. 4 is an enlarged view of the vicinity of the toner roller 38. FIG. 5 shows the same as seen from the arrow D in FIG. 4. An end seal 40 as a sealer is provided at both ends of an opening of the toner supply chamber 36 to contact both ends of the toner roller 38 and prevent a toner leakage therefrom.

The toner container 35 includes the toner conveyer 32 to carry the toner in parallel to (vertically in FIG. 2) the rotational shaft of the photoconductor drum 25. The toner in the toner container 35 is for example manufactured by a polymerization method and its average particle size is 6.5 [μm], a degree of circularity is 0.98, and an angle of repose is 33 degrees. It contains strontium titanate as an external additive. However, the toner for use in the printer 10 should not be limited thereto.

The toner conveyer 32 in FIG. 3 comprises carrier screws 32C, 32D with spiral blades 32B, a long carrier plate 32E, and a rotational shaft 32A at the center to which the screws 32C, 32D and plate 32E are attached. The carrier screws 32C, 32D are provided on the left and right sides of the rotational shaft 32A, respectively, with the plate 32E located in between them and their spiral forms are reverse from each other. The toner conveyer 32 is disposed so that the carrier plate 32E matches the inlet 37A of the partition 37.

The rotational shaft 32A of the toner conveyer 32 is rotated by a motor to rotate the carrier screws 32C, 32D and carry the toner along the arrows E1, E2 in FIG. 3 from the toner container 35 to around the carrier plate 32E. The arrows E1, E2 are approximately horizontal to the rotational shaft 32A. The gathered toner is sent to the toner supply chamber 36 by the rotation of the carrier plate 32E via the inlet 37A of the partition 37.

In replace of the carrier screws 32C, 32D, a carrier belt or a coil-like rotary element can be used for the toner conveyer. Also, such a conveyer combined with a detangling element such as paddle formed by bending a blade or wire can be used. Further, the toner can be carried in a direction orthogonal and approximately horizontal to the rotational shaft 32A of the toner conveyer 32.

The agitator 33 is placed in the toner supply chamber 36 below the partition 37. It comprises agitation screws 33C, 33D, 33E, 33F having blades 33B, a long plate 33G, and a rotational shaft 33A at the center, as shown in FIG. 3. The agitation screws 33C, 33D, 33E, 33F and agitation plate 330 are attached to the rotational shaft 33A. The agitation screws 33C, 33D, 33E, and 33F are provided on the left and right sides of the rotational shaft 32A, respectively, with the plate 330 located in between them. The spiral forms of the agitation screws 33C, 33D are reverse from each other and so are those of the agitation screws 33E, 33F and the agitation screws 33D, 33E.

The agitator 33 is placed so that the agitation plate 33G matches the inlet 37A of the partition 37, a border 33CD of the agitation screws 33C, 33D matches the outlet 37B, and a border 33EF of the agitation screws 33E, 33F matches the outlet 37C.

The rotational shaft 33A of the agitator 33 is rotated by a motor to rotate the agitation screws 33C, 33D, 33E, 33F to agitate the toner in the chamber 36 and supply it to the toner roller 38 and the toner supply roller 34 below. At the same time the agitator 33 carries the toner along the arrows F1, F2 (approximately horizontal to the rotational shaft 33A) to near the border 33CD between the agitation screws 33C, 33D.

That is, the agitator 33 carries a part of the toner supplied from the inlet 37A along the arrow F2 to below the outlet 37B by the rotation of the agitation screw 33D while it carries the toner reaching outside the outlet 37B (left end in FIG. 3) along the arrow F1 to below the outlet 37B by the rotation of the agitation screw 33C.

Likewise, the agitator 33 carries a part of the toner supplied from the inlet 37A along the arrow F3 to below the outlet 37C by the rotation of the agitation screw 33E while it carries the toner reaching outside the outlet 37C (right end in FIG. 3) along the arrow F4 to below the outlet 37C by the rotation of the agitation screw 33F.

Thus, the toner collected below the outlets 37B, 37C is pushed up in a hill form by the pressure from the right and left sides of the agitator 33 along the axis. Thereby, if the toner is excessively supplied to the toner supply chamber 36, an excessive toner is accumulated below the outlets 37B, 37C and returned to the toner container 35 therefrom via the outlets 37B, 37C.

A part of the toner in the toner container 35 enters the toner supply chamber 36 via the outlets 37B, 37C. However, the amount thereof can be minimized since the toner is pushed up in a hill form below the outlets 37B, 37C.

In replace of the agitation screws 33A to 33D, a carrier belt or a coil-like rotary element can be used for the toner agitator. Also, such an agitator combined with a detangling element such as paddle formed by bending a blade or wire can be used. Further, the toner can be carried in a direction orthogonal and approximately horizontal to the rotational shaft 33A of the agitator 33.

The surface of the toner supply roller 34 is coated with a foam material having a cell structure so that the toner can be efficiently attached on the roller 34 from the chamber 36. Coated with the foam material, the toner supply roller 34 can prevent a degradation of the toner arising from the pressure concentrated on a contact portion with the toner roller 38. The electric resistance of the foam material is set to $10^3$ to $10^{14}$ [Ω]. The toner supply roller 34 rotates counterclockwise as indicated by the arrow in FIG. 2 to supply and spread the toner on the surface of the toner roller 38.

A toner layer restrictor 39 is disposed above the toner roller 38, contacting the surface of the toner roller 38 at a tip. The toner on the toner roller 38 is carried to a contact point with the toner layer restrictor 39 along with the rotation of the toner roller 38. The tip of the toner layer restrictor 39 is a free end which presses the surface of the toner roller 38 at a force of 10 to 100[N/m]. It applies the pressure to the toner passing on the toner roller 38 to reduce the amount of a toner layer and apply an electric charge to the toner by friction.

The photoconductor drum 25 in FIG. 2 rotates clockwise. Because of this, the toner roller 38 and photoconductor drum 25 rotate in the same direction in a develop area in which the toner roller 38 and photoconductor drum 25 oppose to each other. The toner roller 38 rotates to carry the reduced toner layer to the develop area. In the develop area the toner layer is transferred to the surface of the photoconductor drum 25 by the bias applied to the toner roller 38 and the electric field formed by the electrostatic latent image on the photoconductor drum 25. Thereby, the electrostatic latent image is developed.

A remnant toner unused for the developing is returned to the chamber 36 from the toner roller 38. A neutralizing seal 41 is provided in the chamber 36, contacting the toner roller 38, to block the toner from leaking to the outside of the develop unit 27.

Now, how to develop the toner on the toner roller 38 on the photoconductor drum 25 is described.

The toner is supplied to a predetermined position of the toner roller 38 and carried to the develop area while passing the neutralizing seal 41 to form a thin toner layer thereon. The thin toner layer is attached onto the electrostatic latent image on the photoconductor drum 25 in the develop area by the develop electric field between the toner roller 38 and the electrostatic latent image. Thereby, the electrostatic latent image is developed. The toner unused for the developing is returned to the toner supply chamber 36 by the rotation of the toner roller 38 and repeatedly used.

Figure 6:
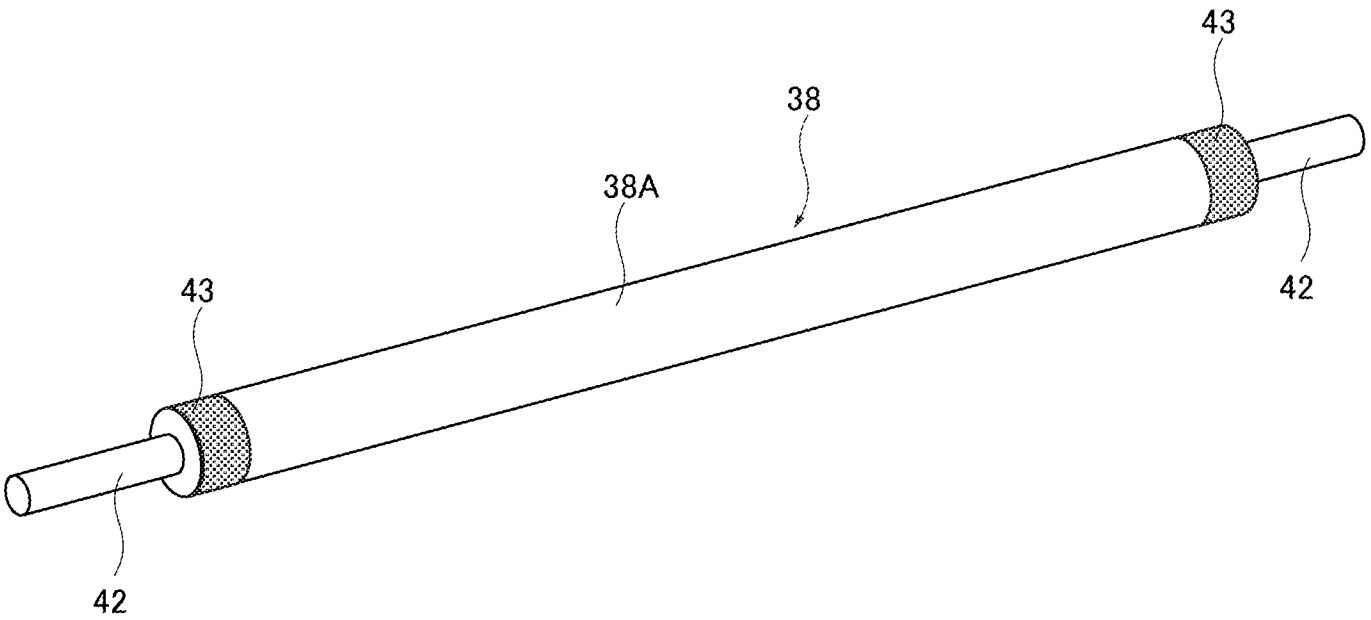
FIG. 6 is a perspective view of the overall toner roller according to a first embodiment.
Figure 7:
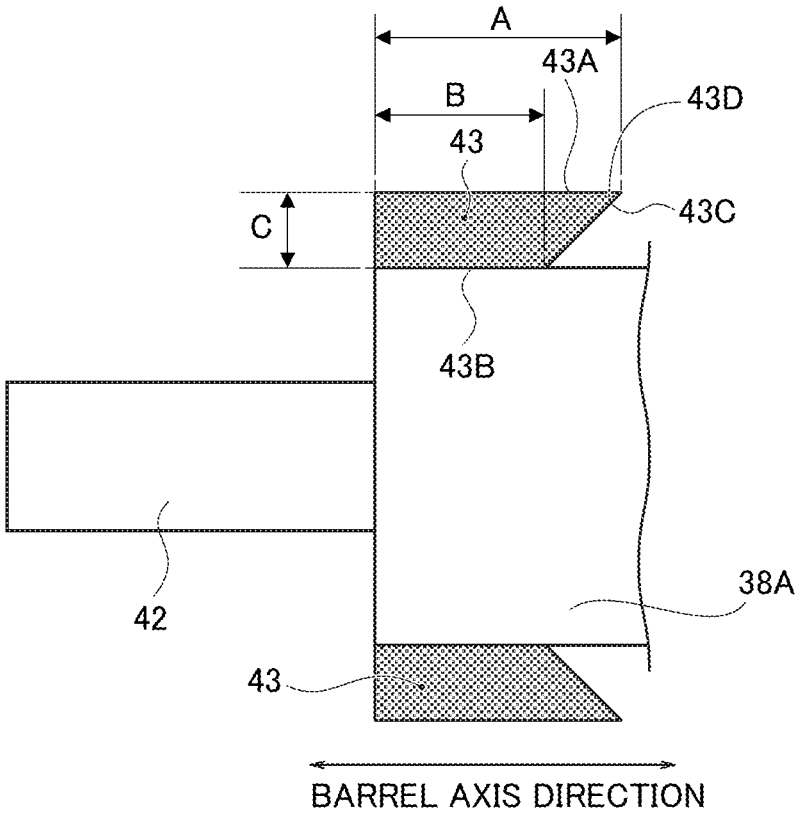
FIG. 7 is a cross sectional view of a coating on the ends of the toner roller in FIG. 6.

Next, the structure of the toner roller is specifically described referring to FIGS. 6 and 7.

The toner roller 38 in FIG. 6 comprises a conductive metal core 42 and a barrel 38A outside the metal core. The barrel 38A includes one or more elastic layers on the outer circumference of the metal core 42 and a coating 43 at both ends. The barrel 38A can include one or more surface layers on the outer circumference of the elastic layers.

The metal core 42 is also a support for the toner roller 38 in a cartridge body. Preferably, it is entirely or at least the surface thereof is made from a conductive material. For example, it can be made from Al, Cu alloy, SUS or SUS alloy, iron plated with Cr and Ni, or synthetic resin plated with Cr and Ni. Further, the metal core of the toner roller 38 for use in an electrophotographic image forming device is generally from 4 to 10 mm in outer diameter.

The elastic layer of the toner roller 38 is a molded element and chiefly made from a rubber or a resin. It can be either solid or porous. Various kinds of known rubber can be used, for example, ethylene propylene diene rubber (EPDM), acrylonitrile butadiene rubber (NBR), chloroprene rubber (CR), natural rubber (NR), isoprene rubber (IR), styrene-butadiene rubber (SBR), fluorine-containing rubber, silicon rubber, epichlorohydrin rubber, hydroxide NBR, polysulfide rubber, urethane rubber, or the like.

Further, various kinds of thermoplastic resin can be used, for example, polyethylene resin such as low density polyethylene (LDPE), high density polyethylene, (HDPE), linear low density polyethylene (LLDPE), ethylene-vinyl acetate copolymer (EVA), polypropylene resin, polycarbonate resin, polystyrene resin, ABS resin, polyester resin such as polymide, polyethylene terephthalate, polybutylene terephthalate, fluorine resin, or polyamide resin such as polyamide 6, polyamide 66, MXD6.

These rubbers or resins can be used solely or two or more kinds can be mixed.

The principal component of the toner roller 38 can be mixed arbitrarily with a conductive agent or non-conductive filler necessary for the function of the elastic layer as well as with various kinds of additives such as cross-linker, catalyser, dispersing accelerant for use in molding a rubber or resin element. Either or both of an ion conductive material by ion conductivity and a conductivity promoter by electric conductivity can be used for the conductive agent.

Examples of the conductivity promoter are as follows: a metal fiber or powder such as aluminum, palladium, iron, copper, silver, metal oxide such as titanium oxide, tin oxide, zinc oxide, a metal compound powder such as copper sulfide, zinc sulfide, a powder formed by attaching tin oxide, antimony oxide, indium oxide, molybdenum oxide, zinc, aluminum, gold, silver, copper, chrome, cobalt, iron, lead, platinum, or rhodium on a proper particle by electrolytic treatment, spray coating, or mixing or shaking, and a carbon black conductive agent such as acetylene black, Ketjenblack (product name), FAN based carbon black, pitch based carbon black, carbon nanotube.

Further, examples of the ion conductive material are as follows: alkali metal salt such as $LiCF_3$ $SO_3$, $NaClO_4$, $LiClO_4$, $LiAsF_6$, $LiBF_4$, NaSCN, KSCN, NaCl, ammonium salt such as $NH_4Cl$, $NH_4SO_4$, $NH_4NO_3$, alkali-earth metal salt such as $Ca(ClO_4)_2$, $Ba(ClO_4)_2$, or a complex of one of these metal salts and polyalcohol such as 1,4-butanediol, ethylene glycol, polyethylene glycol, propylene glycol, polypropylene glycol, or their derivatives, a complex of one of these metal salts and a monool such as ethylene glycol monomethyl ether, ethylene glycol monoethyl ether, polyethylene glycol monomethyl ether, polyethylene glycol monoethyl ether, a cation surfactant such as quaternary ammonium salt, an anion surfactant such as aliphatic sulfonate, alkyl sulfate ester salt, alkyl phosphate ester salt, and an ampholytic surfactant such as betaine.

These conductive agents can be used solely or two or more kinds can be mixed.

The thickness of the elastic layer is preferably 0.5 mm or more, more preferably 1.0 mm or more for the purpose of securing a nip width and satisfying good setting with the photoconductor drum. The upper limit of the thickness is arbitrary as long as the precision of the outer diameter of the develop roller is not impaired.

However, an excessively thick elastic layer is not preferable because a distortion may occur in a contact portion with another element when the develop roller and the element are in contact for a long time. For a practical use, the thickness should be 6.0 mm or less, more preferably 5.0 mm or less. It should be decided in accordance with the hardness thereof to realize a desired nip width. In the present embodiment the elastic layer can be formed by a known method as extrusion molding or injection molding, however, it should not be limited thereto.

With use of a porous elastic layer, the form of cells can be either independent air bubbles or continuous air bubbles. In view of the strength of the elastic layer, independent air bubbles are preferable. Further, its cell diameter is preferably from 5 μm or more and 200 μm or less. At the cell diameter of 5 μm or more, a sufficient surface roughness needed to carry a toner can be achieved while at 200 μm or less, a toner roller with a good compression set can be realized.

The porous elastic layer can be manufactured by a known method, for example, physical foaming, chemical foaming, microencapsulation, or extraction. A foaming agent for use in the chemical foaming can be arbitrarily decided as far as it is thermally decomposed during heating of a resin composition in question and generates gas. For instance, azodicarbonamide, dinitrosopentamethylenetetramine, or 4,4'-oxybisbenzenesulfonylhydrazide can be used. Also, they can be used solely or two or more of them can be mixed. Microencapsulation refers to using a micro capsule of a thermoplastic resin containing impregnated gaseous components such as butane, propane, pentane, isobutene, isooctane, or isopentane. The extraction refers to dispersing an inorganic filler in a resin to form a resin composition containing the inorganic filler, immersing the resin composition in a solution, and dissolving and removing inorganic particles to thereby form holes in the resin composition.

Furthermore, the elastic layer can be comprised of two or more layers as long as it comprises the features described above.

The coating 43 is made from a material with a small friction coefficient and a good wear and abrasion resistance. For example, the following materials can be used: a fluorine resin such as polytetra fluoroethylene (PTFE), polytetrafluoroethylene-hexafluoropropene copolymer resin (FEP), polytetrafluoroethylene-perfluoroalkylvinylether copolymer resin (PFA), polychlorotrifluoroethylene (PCTFE), ethylene-polytetrafluoroethylene copolymer (ETFE), ethylene-chlorotrifluoroethylene copolymer (ECTFE), polyvinyliden fluoride (PVDF), polyvinyl fluoride (PVF), fluoroethylene vinyl ether (FEVE), a polyamide resin such as polyamide 6, polyamide 66, MXD6, polyacetal (POM), polycarbonate (PC), polybutylene terephthalate (PBT), ultra high molecular weight polyethylene (U-PE), polysulfone (PSF), polyether sulfone (PES), polyphenylenesulfide (PPS), polyetheretherketone (PEEK), polyarylate (PAR), polyamide imide (PM), polyimide (PI), polyetherimid (PEI), liquid crystal polymer (LCP), or silicon resin.

The principal component of the coating 43 can be mixed arbitrarily with the above-described conductive agent or non-conductive filler as well as with various kinds of additives such as cross-linker, catalyser, dispersing accelerant necessary for molding a resin element.

The principal component of the coating 43 can also contain inorganic particles for the purpose of improving an abrasion resistance, for example, silica, alumina, titanium oxide, barium titanate, magnesium titanate, calcium titanate, strontium titanate, zinc oxide, tin oxide, silica sand, clay, mica, wollastonite, diatomite, chrome oxide, cerium oxide, red iron oxide, antimony trioxide, magnesium oxide, zirconium oxide, barium sulfate, barium carbonate, calcium carbonate, silicon carbide, or silicon nitride. One of these materials can be used solely or two or more of them can be used together. The amount thereof is preferably about 0.1 to 20 wt % and average particle size is preferably about 5 nm to 1 μm.

Also, to improve the adhesion between the coating 43 and elastic layer or between the elastic layer and surface layer, an adhesive or a primer can be used when appropriate.

The thickness of the coating 43 is preferably from 5 μm or more and 120 μm or less. Within this range, the coating 43 can be prevented from abrasion even over a long-time use.

Next, the features of the present embodiment are described. FIG. 7 is a cross section view of one end of the barrel 38A. The coating 43 is formed on both ends of the barrel 38A of the toner roller.

The width A of the outer circumference 43A of the coating 43 along the axis of the barrel 38A is larger than that B of the inner circumference 43B thereof. One end of the coating 43 close to the metal core 42 protruding from the barrel 38A coincides with the end surface of the barrel 38A. The other end far from the protruding metal core 42 is a reversely tilted surface 43C because the width A is larger than the width B, as described above. The reversely tilted surface 43C protrudes larger towards the center of the barrel 38A (rightward in FIG. 7) on the outer circumference 43A side than on the inner circumference 43B side. Because of this, it is possible to surely avoid the toner from getting over the coating 43 and leaking from the barrel 38A.

Further, it is preferable that (width A−width B) is smaller than the thickness C of the coating 43. Thereby, when pressed onto the end seal 40 in FIGS. 4, 5, the edge 43D of the outer circumference of the coating is prevented from being deformed, that is, the reversely tilted surface 43C is prevented from being bent to touch the barrel 38A at the edge 43D.

The edge 43D of the coating 43 can be chamfered or R-formed.

Preferably, the width of the coating 43 is within a range from the end of the elastic layer of the toner roller 38 to a border between the end seal 40 and the opening of the developer container in FIG. 5, with the width A of the outer circumference 43A of the coating 43 taken as a reference. It can be arbitrarily determined in accordance with other system conditions.

According to the present embodiment since the width A of the outer circumference 43A of the coating 43 is larger than that B of the inner circumference 43B, it can block the toner and prevent it from getting over the coating and leaking from the barrel 38A. Further, the coating 43 is provided at both ends of the barrel 38A to be able to protect them from abrasion.

Generally, in order to prevent a toner leakage, the coating 43 is formed to contact the end seal 40 of the develop unit. However, according to the present embodiment the toner does not get over the coating 43 and enter between the coating 43 and end seal 40. This can prevent the generation of a friction heat from the contact between the toner and end seal 40.

According to the present embodiment it is made possible to reduce a toner dispersion due to the abrasion of the ends of the barrel 38A, a toner degradation due to a friction heat and a toner adherence onto the toner layer restrictor 39 over a long period of time even in a high-speed operation of the image forming device. As a result, it is able to reduce defects of an image such as white lines and contamination inside the image forming device arising from the toner dispersion.

The coating 43 is formed so that the difference (A−B) in its widths is smaller than its thickness C. Because of this, the edge 43D of the coating 43 can be avoided from being deformed, and a toner leakage from the barrel 38A over the coating 43 can be certainly reduced.

Next, results of experiments conducted on the toner roller according to the present embodiment are described by way of example.

First, regarding the toner roller, the metal core made from a SUM material with outer diameter 8 mm with a nickel plating was used. To produce the elastic layer, a polymer of epichlorohydrin rubber and acrylonitrile butadiene rubber was molded by crosshead extrusion and then subjected to vulcanization at 165 degrees C. for two hours. Offset amount (distance between nipple end and dice end) in the crosshead extrusion was 33 mm. Thereafter, the barrel 38A with outer diameter of 16 mm was finished by outer grinding. In the following the composition of the polymer is shown.

| | |
|---|---|
| epichlorohydrin rubber (ECO) | 30 weight % |
| acrylonitrile butadiene rubber (NBR) | 70 weight % |
| calcium carbonate | 30 weight % |
| Carbon black | 2 weight % |
| Vulcanization accelerant | 3 weight % |
| Sulfur | 1 weight % |

Note that the amounts of calcium carbonate, carbon black, vulcanization accelerant, and sulfur are weight % relative to the polymer in which ECO and NBR are blended.

Then, a surface layer in thickness of 1 μm was formed on the barrel by spray coating. The composition of the surface layer is as follows.

| | |
|---|---|
| polyester resin | 80 weight % |
| melamine resin | 20 weight % |
| carbon black | 10 weight % |

As a solvent, a mixture of butyl acetate, isopropyl alcohol, and methyl ethyl ketone was used.

After the spray coating the barrel was calcined for one hour at 150 degrees C. to form a toner roller. The surface roughness Rz of the toner roller was 15 μm at maximum and about 6 μm on average. Undulation Wcm or unevenness on the surface was 5 μm or less.

Then, the above toner roller was actually mounted in an image forming device (printer IPSIO SP C320 manufactured by RICOH Co., Ltd) for evaluation. In this experiment photoconductor drums were charged with a 820V voltage and applied with a develop bias voltage of 250V and a polymerized one-component toner of cyan color (average particle size 6 μm) was used to generate solid images on A4 size papers of portrait orientation. After printing of 100,000 sheets of paper, generated images were evaluated in terms of a toner dispersion and an occurrence of white spots. No occurrence of toner dispersion and white spots was evaluated as good (OK) while the occurrence thereof was evaluated as no good (NG).

Experiment 1

A coating as follows was molded and attached on both ends of the barrel 38A.

Material: ultra high molecular weight polyethylene tape (5160T, manufactured by Sumitomo 3M Limited)

Thickness C: 50 μm

Width A of outer circumference: 3.51 mm

Width B of inner circumference: 3.50 mm

The tape was processed by grinding with a bench grinder (IM-P2 by IMT Co., Ltd) so that the difference (A−B) in widths became 10 μm. The count of a grinding stone used was #1000 and the rotation speed thereof was 200 rpm.

Experiment 2

A difference from the toner roller in Experiment 1 was in the widths of outer and inner circumferences. The width A of the outer circumference was 3.525 mm and the width B of the inner circumference was 3.50 mm. The difference (A−B) between the widths A, B was 25 μm. The rest of the structure was the same as that of the toner roller in Experiment 1.

Experiment 3

A difference from the toner roller in Experiment 1 was in the widths of outer and inner circumferences. The width A of the outer circumference was 3.545 mm and the width B of the inner circumference was 3.50 mm. The difference (A−B) between the widths A, B was 45 μm. The rest of the structure was the same as that of the toner roller in Experiment 1.

Experiment 4

A difference from the toner roller in Experiment 2 was in the material of the tape. A PTFE tape (Nittoflon No. 903UL by Nitto Denko Corporation) was used. The rest of the structure was the same as that of the toner roller in Experiment 2.

Experiment 5

A difference from the toner roller in Experiment 2 was in the material of the tape. A FEP tape (7-672-01 by As One Corporation) was used. The rest of the structure was the same as that of the toner roller in Experiment 2.

Comparison 1

No coating was formed on both ends of the barrel 38A.

Comparison 2

A difference from the toner roller in Experiment 1 was in the widths of outer and inner circumferences. The widths A, B of the outer circumference and the inner circumference were both 3.50 mm. There was no difference therebetween. The rest of the structure was the same as that of the toner roller in Experiment 1.

Comparison 3

A difference from the toner roller in Experiment 1 was in the widths of outer and inner circumferences. The width A of the outer circumference was 3.49 mm and the width B of the inner circumference was 3.50 mm. The difference (A−B) between the widths A, B (A−B) was −10 μm. The rest of the structure was the same as that of the toner roller in Experiment 1.

The results of the Experiments 1 to 5 and the Comparisons 1 to 3 are shown in Table 1.

TABLE 1

| | COATING | | | AFTER PRINTING 100K PAPERS | |
|---|---|---|---|---|---|
| | A − B | MATERIAL | THICKNESS (C) | TONER DISPERSION | WHITE STREAKS |
| Experiment 1 | 10μ | ULTRA HIGH MOLECULAR WEIGHT PE | 50μ | OK | OK |
| Experiment 2 | 25μ | ULTRA HIGH MOLECULAR WEIGHT PE | 50μ | OK | OK |
| Experiment 3 | 45μ | ULTRA HIGH MOLECULAR WEIGHT PE | 50μ | OK | OK |
| Experiment 4 | 25μ | PTFE | 50μ | OK | OK |
| Experiment 5 | 25μ | FEP | 50μ | OK | OK |
| Comparison 1 | None | — | — | NG | NG |
| Comparison 2 | 0μ | ULTRA HIGH MOLECULAR WEIGHT PE | 50μ | NG | NG |
| Comparison 3 | −10μ | ULTRA HIGH MOLECULAR WEIGHT PE | 50μ | NG | NG |

As shown in Table 1, in Experiments 1 to 5 no toner dispersion and white spots or white streaks on images occurred and they were evaluated as good (OK in the table). Meanwhile, in Comparisons 1 to 3 both toner dispersion and white spots occurred and they were evaluated as not good (NG in the table).

Thus, it is proved that the toner roller according to the present embodiment does not generate toner dispersion and white spots.

Second Embodiment

Figures 8A, 8B, 8C, 8D:
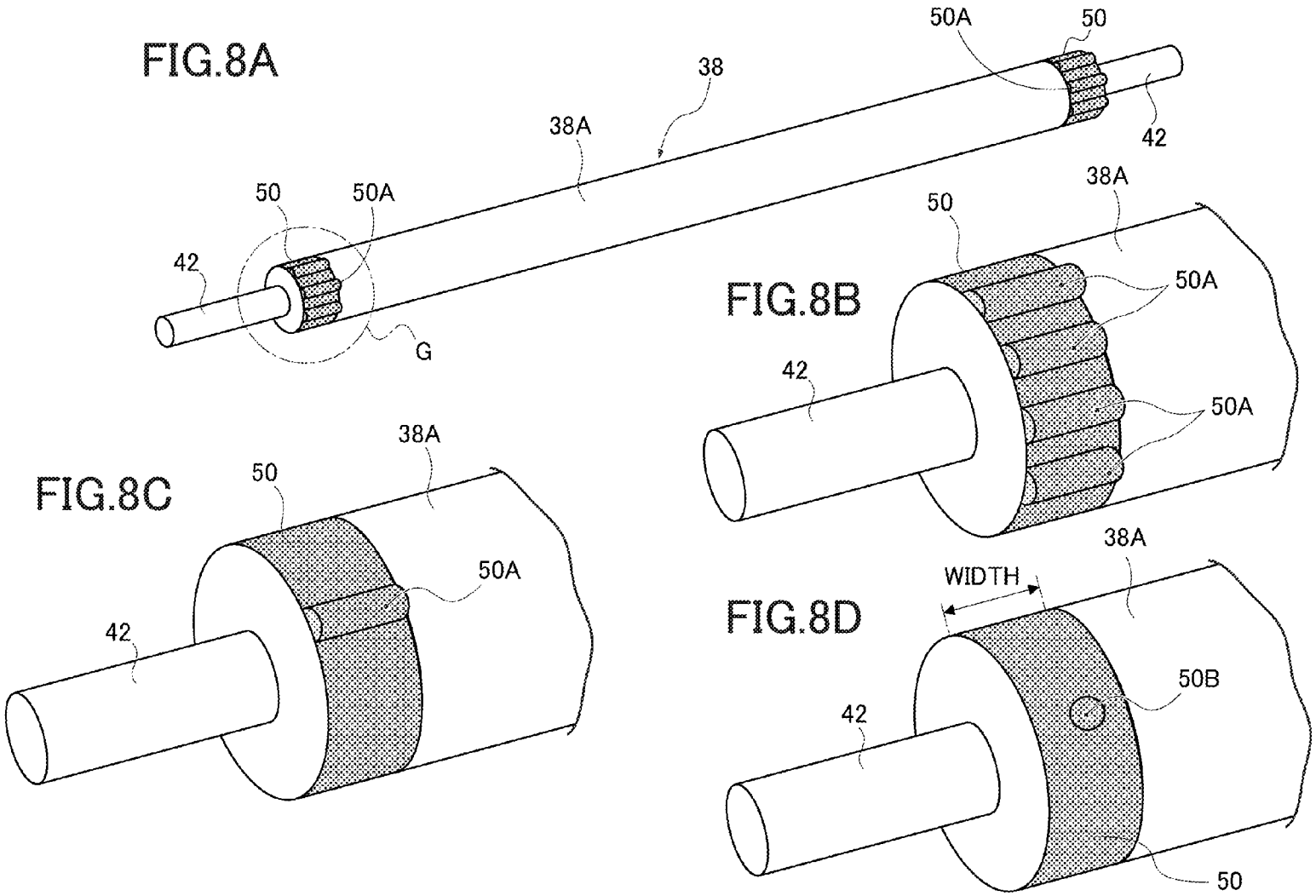
FIGS. 8A to 8D are perspective views of the toner roller according to a second embodiment.

FIGS. 8A to 8D and FIGS. 9A to 9J show a toner roller according to a second embodiment. In FIG. 8A a coating 50 at both ends of the barrel 38A has a thin portion and a thick portion and at least one portion in a larger thickness than the rest of the coating. The coating 50 is covered all over the outer circumference of both ends of the barrel 38A and includes protrusions 50A at four places along the axis of the barrel 38A.

A difference between the thick portion and thin portion of the coating 50 should be preferably from 5 μm or more to 120 μm or less. In this range the coating 50 functions to prevent toner leakage from the ends of the barrel 38A as well as reduce a contact area between the coating 50 and end seal 40 (FIGS. 4, 5) and reduce generation of a friction heat.

The width of the coating 50 is preferably within a range from the end of the elastic layer of the toner roller 38 to a border between the end seal 40 and the opening of the developer container in FIG. 5. It can be arbitrarily determined in accordance with other system conditions.

FIG. 8B is an enlarged view of a G-portion of FIG. 8A. In FIG. 8B the four protrusions 50A each have a cylindrical outer surface and are formed with equal intervals along the circumference of the coating 50. The number of the protrusions is not limited to four and it can be one as shown in FIG. 8C or five or more.

Instead of the protrusions 50A, a single convex 50B can be provided at the center of the width of the coating 50, as shown in FIG. 8D. The outer surface of the convex 50B is semi-spherical.

In FIGS. 8A to 8D the protrusions 50A or convex 50B constitute the thick portion of the coating 50 and the rest thereof constitutes the thin portion.

According to the present embodiment the unevenness of the thickness or the thick and thin portions of the coating can help effectively prevent toner leakage from the ends of the barrel 38A and reduce generation of a friction heat because of a contact between the coating 50 and end seal 40.

FIGS. 9A to 9J are cross section views of the end of the barrel 38A with the coating 50 and show various examples of protrusions and convexes. Now, the experiments conducted are described, referring to FIGS. 9A to 9D.

Experiment 6

A coating 50 as follows was molded and attached onto the entire outer circumferences of both ends of the barrel 38A.

Material: ultra high molecular weight polyethylene tape in thickness of 50 μm (5160T, manufactured by Sumitomo 3M Limited)

Width: 3.5 mm

Figure 9A:
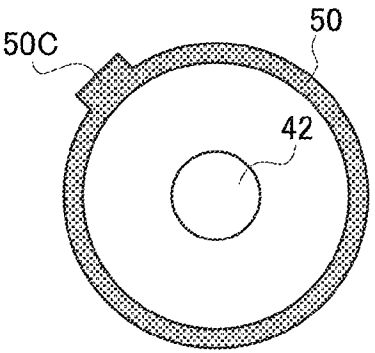
FIGS. 9A to 9D show the cross sections of the coating with a protrusion.

Then, the same kind of tape of width 3.5 mm and length 2.0 mm was attached on the polyethylene tape to create a difference in thickness, as shown in FIG. 9A. The difference in the thickness of the coating 50 was 50 μm. One protrusion 50C was provided and its shape was rectangular with no roundness at corners.

Experiment 7

A coating 50 as follows was molded and attached onto the entire outer circumferences of both ends of the barrel 38A.

Material: ultra high molecular weight polyethylene tape in thickness of 50 μm (5160T, manufactured by Sumitomo 3M Limited)

Width: 3.5 mm

Figure 9B:
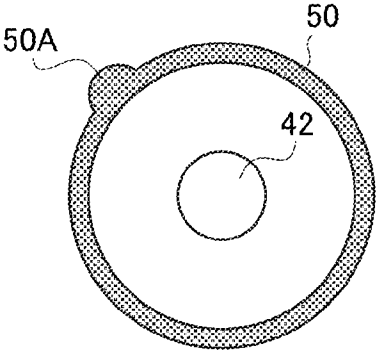

Then, the same kind of tape of width 3.5 mm and length 2.0 mm whose surface edge was R-shaped was attached on the polyethylene tape to create a difference in thickness, as shown in FIG. 9B. The difference in the thickness of the coating 50 was 50 μm. One protrusion 50A having a round outer surface was provided. This coating is the same as the one in FIG. 8C.

Experiment 8

A coating 50 as follows was molded and attached onto the entire outer circumferences of both ends of the barrel 38A.

Material: ultra high molecular weight polyethylene tape in thickness of 50 μm (5160T, manufactured by Sumitomo 3M Limited)

Width: 3.5 mm

Figure 9C:
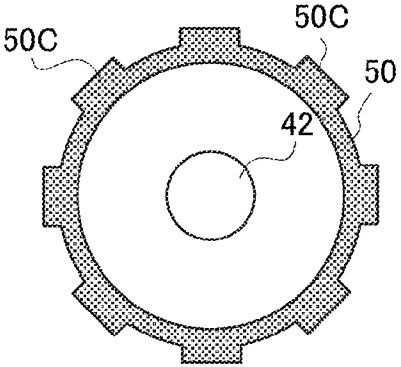

Then, several tapes of the same kind of width 3.5 mm and length 2.0 mm were prepared and attached on the coating 50 with interval of 2.0 mm to create a difference in thickness, as shown in FIG. 9C. The difference in the thickness of the coating 50 was 50 μm. Eight protrusions 50C same as those in Experiment 6 were arranged on the circumference of the coating 50 with equal interval.

Experiment 9

A coating 50 as follows was molded and attached onto the entire outer circumferences of both ends of the barrel 38A.

Material: ultra high molecular weight polyethylene tape in thickness of 50 μm (5160T, manufactured by Sumitomo 3M Limited)

Width: 3.5 mm

Figure 9D:
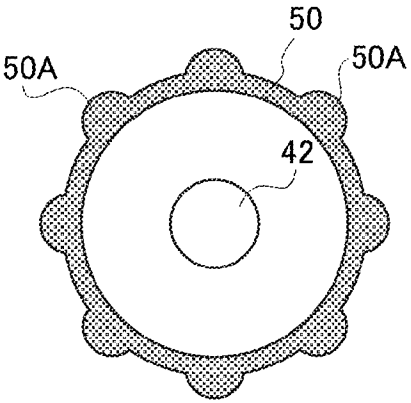

Then, several tapes of the same kind of width 3.5 mm and length 2.0 mm whose surface edge was R-shaped were prepared and attached on the coating 50 with interval of 2.0 mm to create a difference in thickness, as shown in FIG. 9D. The difference in the thickness of the coating 50 was 50 μm. Eight protrusions 50A same as those in Experiment 7 were arranged on the circumference of the coating 50 with equal interval.

Experiment 10

A coating 50 as follows was molded and attached onto the entire outer circumferences of both ends of the barrel 38A.

Material: PTFE tape in thickness of 50 μm (Nittoflon No. 903UL by Nitto Denko Corporation)

Then, the same kind of tape of width 3.5 mm and length 2.0 mm was attached on the tape to create a difference in thickness. The cross section thereof is the same as that in FIG. 9A. The difference in the thickness of the coating 50 was 50 μm.

Experiment 11

A coating 50 as follows was molded and attached onto the entire outer circumferences of both ends of the barrel 38A.

Material: FEP tape in thickness of 50 μm (7-672-01 by As One Corporation)

Then, the same kind of tape of width 3.5 mm and length 2.0 mm was attached on the tape to create a difference in thickness. The cross section thereof is the same as that in FIG. 9A. The difference in the thickness of the coating 50 was 50 μm.

Experiment 12

The coating 50 was prepared by blending fluoroetylene-vinylether (Lumiflon LF200MEK by Asahi Glass Co., Ltd) of 70 weight % with blocked hexamethylene diisocyanate (Duranate TPA-B80E by Asahi Kasei Chemicals Corporation) of 30 weight %. Then, this mixture was diluted with methyl ethyl ketone, coated by spraying onto both ends of the barrel 38A at thickness 50 μm and width 3.5 mm and calcined for one hour at 130 degrees C. After the toner roller was masked, the same mixture was sprayed again to form the coating of width 3.5 mm, length 2.0 mm, thickness 50 μm as in FIG. 9A and create a difference in thickness, and then calcined for one hour at 130 degrees C.

Experiment 13

The coating 50 was prepared by blending fluoroetylene-vinylether (Lumiflon LF200MEK by Asahi Glass Co., Ltd) of 70 weight % with blocked hexamethylene diisocyanate (Duranate TPA-B80E by Asahi Kasei Chemicals Corporation) of 30 weight %. Then, this mixture was diluted with methyl ethyl ketone, coated by spraying onto both ends of the barrel 38A at thickness 50 μm and width 3.5 mm and calcined for one hour at 130 degrees C. After the toner roller was masked, the same mixture was sprayed again to form the coating of width 3.5 mm, length 2.0 mm, thickness 5 μm as in FIG. 9A and create a difference in thickness, and then calcined for one hour at 130 degrees C.

Experiment 14

The coating 50 was prepared by blending fluoroetylene-vinylether (Lumiflon LF200MEK by Asahi Glass Co., Ltd) of 70 weight % with blocked hexamethylene diisocyanate (Duranate TPA-B80E by Asahi Kasei Chemicals Corporation) of 30 weight %. Then, this mixture was diluted with methyl ethyl ketone, coated by spraying onto both ends of the barrel 38A at thickness 50 μm and width 3.5 mm and calcined for one hour at 130 degrees C. After the toner roller was masked, the same mixture was sprayed to form the coating of width 3.5 mm, length 2.0 mm, thickness 120 μm as in FIG. 9A and create a difference in thickness, and then calcined for one hour at 130 degrees C.

Comparison 4

No coating was provided on both ends of the barrel 38A.

Comparison 5

A coating 50 as follows was molded and attached onto the entire outer circumferences of both ends of the barrel 38A.

Material: ultra high molecular weight polyethylene tape in thickness of 50 μm (5160T, manufactured by Sumitomo 3M Limited)

Width: 3.5 mm

There was no difference created in the thickness of the coating.

The results of Experiments 6 to 14 and Comparisons 4 to 5 are shown in Table 2.

TABLE 2

| | COATING | | | AFTER PRINTING 100K PAPERS | |
|---|---|---|---|---|---|
| | SHAPE | MATERIAL | THICKNESS (C) | TONER DISPERSION | WHITE STREAKS |
| Experiment 6 | FIG. 9A | ULTRA HIGH MOLECULAR WEIGHT PE | 50μ | OK | OK |
| Experiment 7 | FIG. 9B | ULTRA HIGH MOLECULAR WEIGHT PE | 50μ | OK | OK |
| Experiment 8 | FIG. 9C | ULTRA HIGH MOLECULAR WEIGHT PE | 50μ | OK | OK |
| Experiment 9 | FIG. 9D | ULTRA HIGH MOLECULAR WEIGHT PE | 50μ | OK | OK |
| Experiment 10 | FIG. 9A | PTFE | 50μ | OK | OK |
| Experiment 11 | FIG. 9A | FEP | 50μ | OK | OK |
| Experiment 12 | FIG. 9A | FLUORINATED PAINT | 50μ | OK | OK |
| Experiment 13 | FIG. 9A | FLUORINATED PAINT | 5μ | OK | OK |
| Experiment 14 | FIG. 9A | FLUORINATED PAINT | 120μ | OK | OK |
| Comparison 4 | None | — | — | NG | NG |
| Comparison 5 | ENTIRELY COATED | ULTRA HIGH MOLECULAR WEIGHT PE | 50μ | NG | NG |

As shown in Table 2, in Experiments 6 to 14 no toner dispersion and white spots or white streaks on images occurred and they were evaluated as good (OK in the table). Meanwhile, in Comparisons 4 to 5 both toner dispersion and white spots occurred and they were evaluated as not good (NG in the table).

Thus, it is proved that the toner roller according to the present embodiment does not generate toner dispersion and cause white spots on images.

In FIGS. 9A to 9D to create unevenness in the thickness of the coating 50, another coating is attached on to the coating 50 at both ends of the barrel 38A. Meanwhile, in FIGS. 9E to 9H the coating 50 is partially scraped.

Figure 9E:
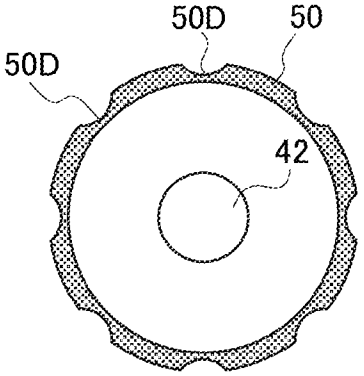
FIGS. 9E to 9H show the same with a concave.

In FIG. 9E the outer circumference of the coating 50 is grounded to be in R-shape and eight R-shape concaves 50D are formed on the surface of the coating 50 along the axis of the barrel 38A (vertically in the drawing) with equal interval.

Figure 9F:
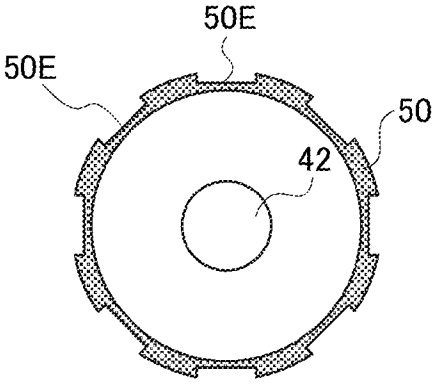

In FIG. 9F the outer circumference of the coating 50 is grounded in a rectangular form and eight rectangular concaves 50E are formed on the surface of the coating 50 along the axis of the barrel 38A with equal interval.

Figure 9G:
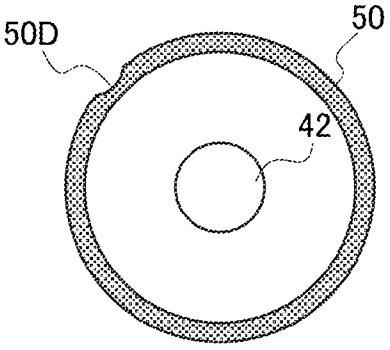
Figure 9H:
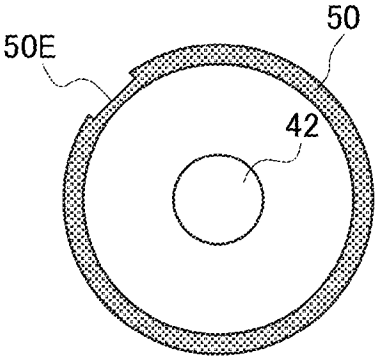

In FIG. 9G one R-shape concave 50D is provided while in FIG. 9H one rectangular concave 50E is provided.

FIGS. 9E to 9H the concaves 50D, 50E constitute the thin portion of the coating 50 and the rest thereof constitutes the thick portion.

Figure 9I:
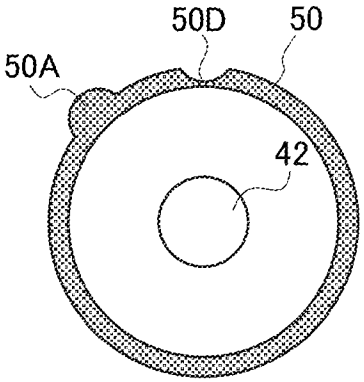
FIGS. 9I and 9J show the same with both a protrusion and a concave.
Figure 9J:
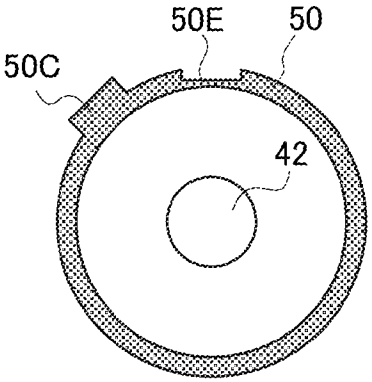

In FIG. 9I one R-shape protrusion 50A in FIG. 9B and one R-shape concave 50D in FIG. 9G are provided. In FIG. 9J one rectangular protrusion 50C in FIG. 9A and one R-shape concave 50E in FIG. 9H are provided The toner rollers in FIGS. 9A to 9J can also prevent the occurrence of toner dispersion and white spots on images, as in Experiments 6 to 14.

Third Embodiment

Figure 10:
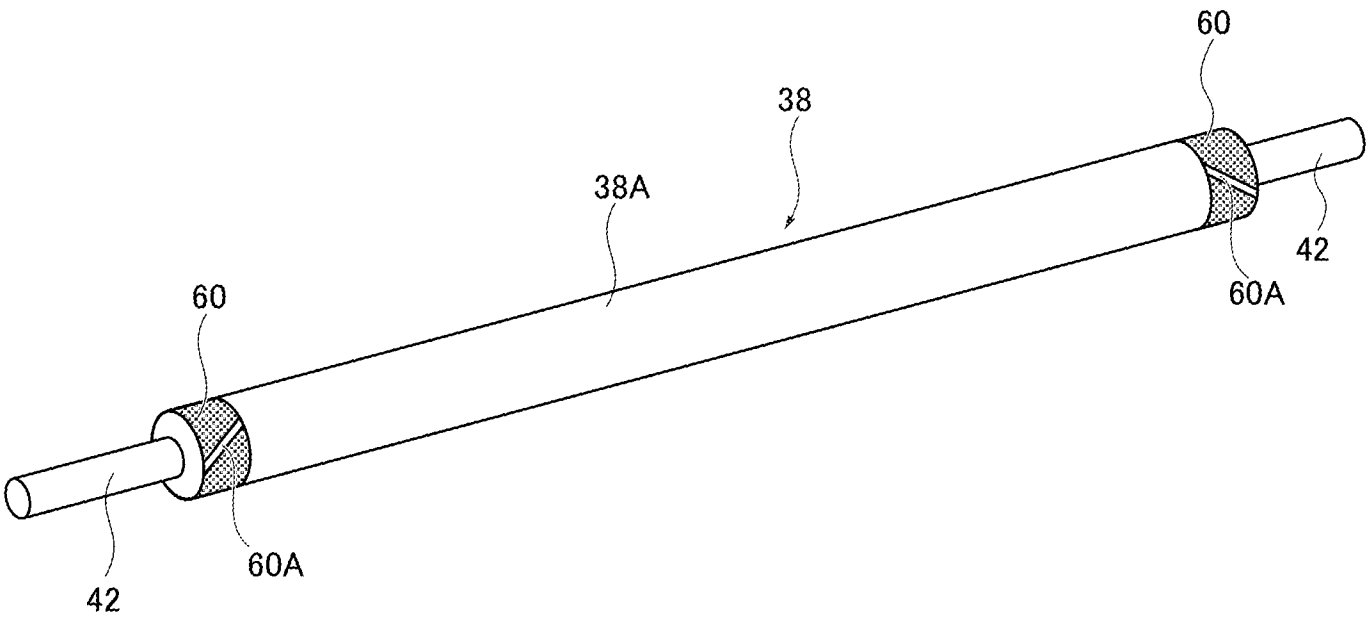
FIG. 10 is a perspective view of the overall toner roller according to a third embodiment.

FIG. 10 and FIGS. 11A to 11F show a toner roller according to a third embodiment. In FIG. 10 a coating 60 at both ends of the barrel 38A includes one discontinuous portion along the circumference of the barrel 38A and unevenness in the thickness. The coating 60 is formed on the outer circumferences of both ends of the barrel 38A and includes one or more gaps 60A (one in the drawing) with no coating. The gaps 60A are inclined at a certain angle (30 degrees, for example)

relative to the axis of the barrel 38A. The gaps at the right and left ends of the barrel 38A are reversely inclined.

Preferably, the thickness of the coating 60 is from 5 μm or more and 120 μm or less. At 5 μm or more, the discontinuous portions or gaps 60A and the end seal 40 (FIGS. 4-5) are unlikely to directly contact each other, which will not cause generation of a friction heat. Also, at 120 μm or less, toner leakage from the gaps 60A can be sufficiently prevented.

The width of the coating 60 is preferably within a range from the end of the elastic layer of the toner roller 38 to a border between the end seal 40 and the opening of the developer container in FIG. 5. It can be arbitrarily determined in accordance with other system conditions.

According to the present embodiment the coating 60 includes one or more discontinuous portions along the circumference of the barrel 38A and unevenness in the thickness. This can help effectively prevent toner leakage from the ends of the barrel 38A and reduce generation of a friction heat because of a contact between the coating 60 and end seal 40.

FIGS. 11A to 11F are side views of the coating 60, showing various examples of the gaps. Referring to FIGS. 11A to 11D, the experiments conducted are described.

Experiment 15

A coating 60 as follows was molded and attached onto the entire outer circumferences of both ends of the barrel 38A.

Material: ultra high molecular weight polyethylene tape in thickness of 50 μm (5160T, manufactured by Sumitomo 3M Limited)

Width: 3.5 mm

Figure 11A:
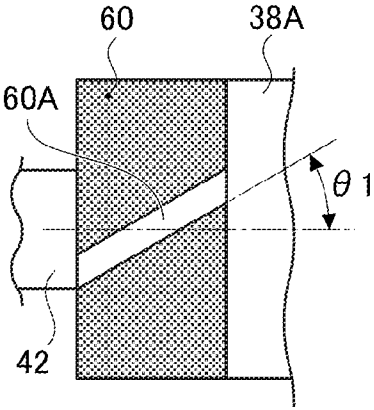
FIGS. 11A and 11B show a side face of the coating according to the third embodiment having a single gap.

The gap 60A in FIG. 11A was formed in width 1.0 mm along the circumference of the coating 60 and inclined at angle θ1 of 30 degrees relative to the axis of the barrel 38A. This coating with one gap 60A is same as the one in FIG. 10.

Experiment 16

A coating 60 as follows was molded and attached onto the entire outer circumferences of both ends of the barrel 38A.

Material: ultra high molecular weight polyethylene tape in thickness of 50 μm (5160T, manufactured by Sumitomo 3M Limited)

Width: 3.5 mm

Figure 11B:
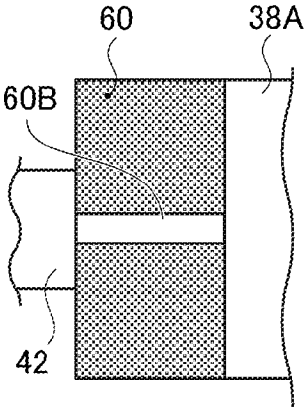

The gap 60B in FIG. 11B was formed in width 1.0 mm along the circumference of the coating 60 and inclined at angle of 0 degree relative to the axis of the barrel 38A. This coating has one gap 60B.

Experiment 17

A coating 60 as follows was molded and attached onto the entire outer circumferences of both ends of the barrel 38A.

Material: ultra high molecular weight polyethylene tape in thickness of 50 μm (5160T, manufactured by Sumitomo 3M Limited)

Width: 3.5 mm

Figure 11C:
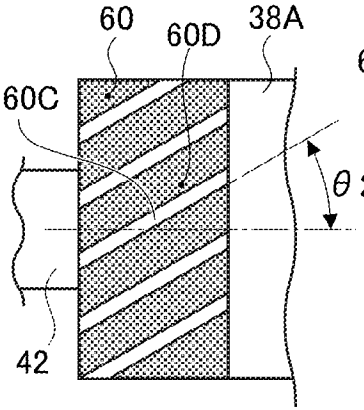
FIGS. 11C and 11D show the same having two or more gaps.

The gaps 60C in FIG. 11C are formed in width 1.0 mm along the circumference of the coating 60 and the widths of coated areas 60D between two gaps 60C are 3.0 mm. The angle θ2 of the gaps 60C and coated areas 60D relative to the axis of the barrel 38A was set to 30 degrees. In this example several gaps 60C are arranged in the coating 60 along the circumference with equal interval.

Experiment 18

A coating 60 as follows was molded and attached onto the entire outer circumferences of both ends of the barrel 38A.

Material: ultra high molecular weight polyethylene tape in thickness of 50 μm (5160T, manufactured by Sumitomo 3M Limited)

Width: 3.5 mm

Figure 11D:
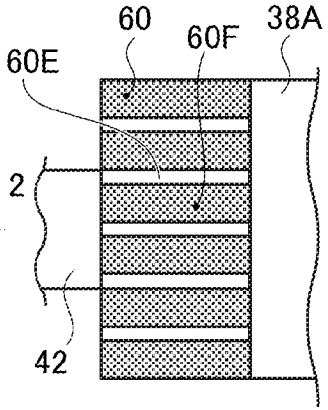

The gaps 60E in FIG. 11D are formed in width 1.0 mm along the circumference of the coating 60 and the widths of coated areas 60F between two gaps 60E are 3.0 mm. The angle of the gaps 60E and coated areas 60F relative to the axis of the barrel 38A was set to 0 degree. In this example several gaps 60E are arranged on the coating 60 along the circumference with equal interval.

Experiment 19

A coating 60 as follows was molded and attached onto the entire outer circumferences of both ends of the barrel 38A.

Material: PTFE tape in thickness of 50 μm (Nittoflon No. 903UL by Nitto Denko Corporation)

Width: 3.5 mm

Similarly to the example in FIG. 11A, the gap 60A was formed in width 1.0 mm along the circumference of the coating 60 and inclined at angle θ1 of 30 degrees relative to the axis of the barrel 38A. This coating includes one gap 60A.

Experiment 20

A coating 60 as follows was molded and attached onto the entire outer circumferences of both ends of the barrel 38A.

Material: FEP tape in thickness of 50 μm (7-672-01 by As One Corporation)

Width: 3.5 mm

Similarly to the example in FIG. 11A, the gap 60A was formed in width 1.0 mm along the circumference of the coating 60 and inclined at angle θ1 of 30 degrees relative to the axis of the barrel 38A. This coating 60 includes one gap 60A.

Experiment 21

The coating 60 was prepared by blending fluoroetylene-vinylether (Lumiflon LF200MEK by Asahi Glass Co., Ltd) of 70 weight % with blocked hexamethylene diisocyanate (Duranate TPA-B80E by Asahi Kasei Chemicals Corporation) of 30 weight %. Then, this mixture was diluted with methyl ethyl ketone, coated by spraying onto both ends of the barrel 38A at thickness 50 μm and width 3.5 mm and calcined for one hour at 130 degrees C. Similarly to the example in FIG. 11A, the gap 60A was formed in width 1.0 mm along the circumference of the coating 60 and inclined at angle θ1 of 30 degrees relative to the axis of the barrel 38A. This coating 60 includes one gap 60A.

Experiment 22

The coating 60 was prepared by blending fluoroetylene-vinylether (Lumiflon LF200MEK by Asahi Glass Co., Ltd) of 70 weight % with blocked hexamethylene diisocyanate (Duranate TPA-B80E by Asahi Kasei Chemicals Corporation) of 30 weight %. Then, this mixture was diluted with methyl ethyl ketone, coated by spraying onto both ends of the barrel 38A at thickness 5 μm and width 3.5 mm and calcined for one hour at 130 degrees C. Similarly to the example in FIG. 11A, the gap 60A was formed in width 1.0 mm along the circumference of the coating 60 and inclined at angle θ1 of 30 degrees relative to the axis of the barrel 38A. This coating 60 includes one gap 60A.

Experiment 23

The coating 60 was prepared by blending fluoroetylene-vinylether (Lumiflon LF200MEK by Asahi Glass Co., Ltd) of 70 weight % with blocked hexamethylene diisocyanate (Duranate TPA-B80E by Asahi Kasei Chemicals Corporation) of 30 weight %. Then, this mixture was diluted with methyl ethyl ketone, coated by spraying onto both ends of the barrel 38A at thickness 120 μm and width 3.5 mm and calcined for one hour at 130 degrees C. Similarly to the example in FIG. 11A, the gap 60A was formed in width 1.0 mm along the circumference of the coating 60 and inclined at angle θ1 of 30 degrees relative to the axis of the barrel 38A. This coating 60 includes one gap 60A.

Comparison 6

No coating was formed on both ends of the barrel 38A.

Comparison 7

A coating 60 as follows was molded and attached onto the outer circumferences of both ends of the barrel 38A.

Material: ultra high molecular weight polyethylene tape in thickness of 50 μm (5160T, manufactured by Sumitomo 3M Limited)

Width: 3.5 mm

This coating 60 includes no discontinuous portions, that is, no-coating portions.

Results of Experiments 15 to 23 and Comparisons 6 and 7 are shown in Table 3.

TABLE 3

| | COATING | | | AFTER PRINTING 100K PAPERS | |
|---|---|---|---|---|---|
| | SHAPE | MATERIAL | THICKNESS (C) | TONER DISPERSION | WHITE STREAKS |
| Experiment 15 | FIG. 11A | ULTRA HIGH MOLECULAR WEIGHT PE | 50μ | OK | OK |
| Experiment 16 | FIG. 11B | ULTRA HIGH MOLECULAR WEIGHT PE | 50μ | OK | OK |
| Experiment 17 | FIG. 11C | ULTRA HIGH MOLECULAR WEIGHT PE | 50μ | OK | OK |
| Experiment 18 | FIG. 11D | ULTRA HIGH MOLECULAR WEIGHT PE | 50μ | OK | OK |
| Experiment 19 | FIG. 11A | PTFE | 50μ | OK | OK |
| Experiment 20 | FIG. 11A | FEP | 50μ | OK | OK |
| Experiment 21 | FIG. 11A | FLUORINATED PAINT | 50μ | OK | OK |
| Experiment 22 | FIG. 11A | FLUORINATED PAINT | 5μ | OK | OK |
| Experiment 23 | FIG. 11A | FLUORINATED PAINT | 120μ | OK | OK |
| Comparison 6 | None | — | — | NG | NG |
| Comparison 7 | ENTIRELY COATED | ULTRA HIGH MOLECULAR WEIGHT PE | 50μ | NG | NG |

As shown in Table 3, in Experiments 15 to 23 no toner dispersion and white spots or white streaks on images occurred and they were evaluated as good (OK in the table). Meanwhile, in Comparisons 6 and 7 both a toner dispersion and white spots occurred and they were evaluated as not good (NG in the table).

Thus, it is proved that the toner roller according to the present embodiment does not generate a toner dispersion and cause white spots on images.

Figure 11E:
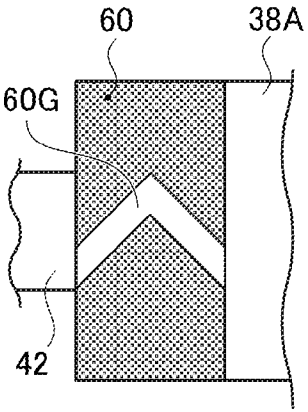
FIGS. 11E and 11F show the same having a gap with a bend.
Figure 11F:
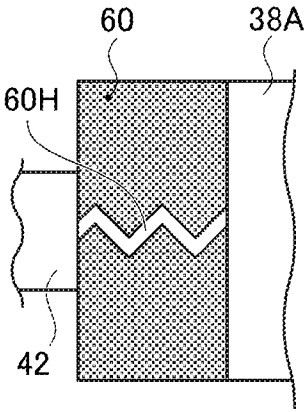

FIG. 11E shows a coating 60 including a gap 60G which is bent at the center of the width. FIG. 11F shows a gap 60H with four bends. The widths of the gaps 600 and 60H along the circumference of the coating 60 are both 1.0 mm. The gaps 60G and 60H are formed at one place and the angle thereof relative to the axis of the barrel 38A are set to 30 degrees.

The toner rollers 38 with the coatings in FIGS. 11E, 11F can also prevent the occurrence of a toner dispersion and white spots on images.

Fourth Embodiment

The toner rollers 38 according to any of the first to third embodiments can be used in the develop unit 27 in FIG. 2.

The toner rollers 38 according to any of the first to third embodiments can be applied to the process cartridges 11 to 14 each comprising the develop unit 27 in FIG. 2.

The toner rollers 38 according to any of the first to third embodiments can be applied to the printer 10 in FIG. 1.

According to any of the first to third embodiments it is made possible to reduce a toner dispersion due to the abrasion of the ends of the barrel 38A over a long period of time even in a high-speed operation of the image forming device as well as to reduce the degradation of a toner due to a friction heat and a toner adherence onto the toner layer restrictor 39. As a result, it is able to reduce defects of an image such as white streaks and contamination inside the image forming device arising from the toner dispersion.

Further, owing to the coating having the difference in the widths of the outer and inner circumferences and the reversely tilted end surface, it is possible to surely prevent the toner from getting over the coating 43 and leaking from the barrel 38A as well as the generation of a friction heat of the toner.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A toner carrier comprising:

a metal core;

a barrel formed on an outer circumference of the metal core and including at least an elastic layer; and a coating formed at outer circumferences of both ends of the barrel, wherein the coating includes at least one protrusion having a larger thickness than a rest of the coating in a radially outward direction from the metal core.

2. The toner carrier according to claim 1, wherein a difference between the at least one protrusion and the rest of the coating is from 5.0 to 120 μm.

3. The toner carrier according to claim 1, wherein an end of the coating in a barrel axis direction, on an inner circumference side protruding from the barrel, coincides with an end surface of the barrel.

4. The toner carrier according to claim 1, wherein the barrel includes the elastic layer and a surface layer on an outer circumference of the elastic layer.

5. The toner carrier according to claim 1, wherein the coating is made from a material with a low friction coefficient.

6. A develop unit comprising:

a toner container; and the toner carrier according to claim 1, of which a toner supplied from the toner container is attached onto an outer circumference.

7. The develop unit according to claim 6, further comprising a sealer to contact with the coating and prevent the toner from leaking to an outside.

8. A process cartridge comprising:

the develop unit according to claim 6; and an image carrier of which a toner image is formed from the toner supplied from the toner carrier on an outer circumference.

9. An image forming device comprising the process cartridge according to claim 8.

* * * * *